US009842472B2

(12) United States Patent
Board et al.

(10) Patent No.: US 9,842,472 B2
(45) Date of Patent: Dec. 12, 2017

(54) LOTTERY REWARDS SYSTEM AND INTERACTIVE DISPLAYS

(71) Applicant: Lotto Points Plus, Inc., Wilmington, DE (US)

(72) Inventors: Brad Board, Kenmore (AU); Jeffrey S. Perlee, Altamont, NY (US)

(73) Assignee: Lotto Points Plus, Inc., Wilmington, DE (US)

( * ) Notice: Subject to any disclaimer, the term of this patent is extended or adjusted under 35 U.S.C. 154(b) by 665 days.

(21) Appl. No.: 14/303,867

(22) Filed: Jun. 13, 2014

(65) Prior Publication Data

US 2014/0378203 A1 Dec. 25, 2014

Related U.S. Application Data

(60) Provisional application No. 61/837,316, filed on Jun. 20, 2013.

(51) Int. Cl.
*G07F 17/32* (2006.01)

(52) U.S. Cl.
CPC ..... *G07F 17/329* (2013.01); *G07F 17/3237* (2013.01); *G07F 17/3255* (2013.01)

(58) Field of Classification Search
CPC ..... G07F 17/329; G07F 17/3255; A63F 3/081
See application file for complete search history.

(56) References Cited

U.S. PATENT DOCUMENTS 6,578,735 B1 * 6/2003 Mothwurf ..... G06Q 30/0212 221/255
6,588,747 B1 7/2003 Seelig
6,663,105 B1 12/2003 Sullivan et al.
7,740,243 B1 6/2010 Kean
7,811,172 B2 10/2010 Asher et al.
7,962,362 B2 * 6/2011 Huang ..... G06Q 30/02 705/14.31
8,007,356 B2 8/2011 York et al.
9,027,832 B1 * 5/2015 Rennard ..... G07F 17/329 235/380
2003/0045340 A1 * 3/2003 Roberts ..... A63F 3/0615 463/17
2005/0075158 A1 * 4/2005 Walker ..... G07F 17/32 463/16
2005/0181875 A1 8/2005 Hoehne et al.
2006/0036482 A1 * 2/2006 Huang ..... G06Q 30/02 705/14.14
2007/0271113 A1 11/2007 Nelson et al.
(Continued)

*Primary Examiner* — Steven J Hylinski
(74) *Attorney, Agent, or Firm* — Matthew J. Kinnier; Hoffman Warnick LLC

(57) ABSTRACT

A consumer gaming loyalty system, which can include: an electronic data processing system operated by a loyalty program operator, the electronic data processing system being independent of a state lottery and a lottery retailer; and a user account defined within the data processing system, the user account configured to store a lottery transaction history provided by at least one of a consumer, the state lottery, the lottery retailer, and the loyalty program operator; and wherein the electronic data processing system is configured to provide least one contest to the consumer through the user account, and the contest is provided by the loyalty program operator independently of the state lottery and a lottery retailer contest.

18 Claims, 7 Drawing Sheets

(56) References Cited

U.S. PATENT DOCUMENTS

| | | | | |
|---|---|---|---|---|
| 2008/0103909 | A1 | 5/2008 | Huang et al. | |
| 2010/0174613 | A1 | 7/2010 | Oram et al. | |
| 2010/0222125 | A1 | 9/2010 | Nyman et al. | |
| 2010/0267438 | A1* | 10/2010 | Williams | G07F 17/32 463/17 |
| 2011/0092267 | A1 | 4/2011 | Hardy et al. | |
| 2012/0149474 | A1 | 6/2012 | Bickley | |
| 2013/0084935 | A1 | 4/2013 | DePaul et al. | |
| 2013/0178269 | A1* | 7/2013 | Shaw | G07F 17/3244 463/16 |
| 2014/0200934 | A1* | 7/2014 | Agarwala | G06Q 10/02 705/5 |
| 2014/0295932 | A1* | 10/2014 | Irwin, Jr. | G07F 17/329 463/17 |

* cited by examiner

View with Tickets or Ticket Samples placed in Display Pockets

LOTTERY REWARDS SYSTEM AND INTERACTIVE DISPLAYS

CROSS-REFERENCE TO RELATED APPLICATIONS

This application claims the benefit of U.S. provisional patent application No. 61/837,316 filed Jun. 20, 2013, which is hereby incorporated herein.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

BACKGROUND

The present disclosure relates generally to instruments, programs, and systems for encouraging consumers to purchase lottery tickets or enter into other gaming transactions. Specifically, the present disclosure relates to a lottery rewards system for encouraging customers to purchase lottery tickets with a program independent of state lotteries and/or vendors.

Generally, a customer can enter into gaming or lottery transactions at a retail site or point of service. At these areas, gaming or lottery products available for purchase may be placed in areas that are obscure or otherwise difficult for the customer to view (e.g., behind a counter or in a separate vending machine). Even when opportunities for gaming or lottery transactions are visible, a customer may still not be interested in participating in a game, lottery, or becoming a member of a player loyalty program for one or more intervening reasons. For example, the visibility of gaming and lottery options may still be low relative to other items in the store, information pertaining to lottery programs may not be current, or the consumer may have low expectations of his or her chance of winning. As a result, the number of customers who purchase lottery and gaming sales may be low if a consumer feels dissuaded, by one of the reasons provided herein or by other reasons, to try or continue to try purchasing lottery and gaming tickets. These problems can also diminish the number of frequent lottery players or impulse customers.

These problems can also be compounded by a lack of consumer incentives programs for prospective purchasers of lottery tickets. Although some retailers may provide lottery-based incentive programs or broader membership programs for their customers, these programs may be somewhat limited by a particular lottery being offered in only one state. In addition, many lottery retail sites (e.g., convenience stores, grocery stores, etc.) may service a limited geographic region of customers even when located in several states. Thus, a consumer who travels frequently or moves from one area to another may not be able to transfer an existing account for an incentive program because it is not offered in the new location.

SUMMARY

A first aspect of the disclosure provides a retail gaming display comprising: an electronic service display configured to be affixed to a countertop surface, wherein the electronic service display provides information pertaining to lottery and gaming services; and a network access link which couples the electronic service display to one of an internal network and an external network, the network access link providing a record of transactions to one of the internal network and external network through the network access link, and one of the internal and external networks is configured to update the electronic service display.

A second aspect of the disclosure provides a retail gaming display comprising: a service display area, wherein the service display area comprises one of a physical gaming ticket and a gaming ticket screen; a winner awareness display connected to the lottery display area, wherein the winner awareness display comprises at least one of a physical photograph, a winner portrait screen, a logo display area, and a winner promotion space; a lottery message display mounted on the lottery display area, wherein the lottery message display comprises one of a written message, a digital message, and an electronic message; and a network access link which connects one of the lottery display area, winner awareness display, and lottery message display to one of an internal and external network, wherein outgoing lottery data is provided to one of the internal and external network through the network access point, and one of the service display area, winner awareness display, and lottery message display is updated with incoming gaming data provided from one of the internal and external network through the network access point.

Another aspect of the disclosure provides a retail gaming display comprising: a service display area, wherein the service display area comprises one of a physical gaming ticket and a gaming ticket screen; a winner awareness display connected to the lottery display area, wherein the winner awareness display comprises at least one of a physical photograph, a winner portrait screen, a logo display area, and a winner promotion space; a lottery message display mounted on the lottery display area, wherein the lottery message display comprises one of a written message, a digital message, and an electronic message; and a network access link which connects one of the lottery display area, winner awareness display, and lottery message display to one of an internal and external network, wherein outgoing lottery data is provided to one of the internal and external network through the network access point, and one of the service display area, winner awareness display, and lottery message display is updated with incoming gaming data provided from one of the internal and external network through the network access point.

A further aspect of the disclosure provides a consumer gaming loyalty system including: an electronic data processing system operated by a loyalty program operator, the electronic data processing system being independent of a state lottery and a lottery retailer; and a user account defined within the data processing system, the user account configured to store a lottery transaction history provided by at least one of a consumer, the state lottery, the lottery retailer, and the loyalty program operator; and wherein the electronic data processing system is configured to provide least one contest to the consumer through the user account, and the contest is provided by the loyalty program operator independently of the state lottery and a lottery retailer contest.

An additional aspect of the disclosure provides a method for promoting lottery transactions, the method including: verifying a lottery ticket submitted from a consumer to an electronic data processing system, the electronic data processing system being independent of a retailer-specific lottery and a state-specific lottery, wherein the lottery ticket corresponds to one of the state-specific lottery, the retailer-specific lottery, and an independent lottery; associating the lottery ticket with a user account stored in the electronic data processing system, wherein the user account is independent of the retailer-specific lottery and the state-specific lottery; and entering the consumer into a lottery independent of the retailer-specific lottery and the state-specific lottery in response to the lottery ticket not being previously verified.

Yet another aspect of the disclosure provides a consumer gaming loyalty system comprising: an electronic data processing system operated by a loyalty program operator; and a user account provided within the data processing system, the user account configured to store gaming information provided by at least one of a lottery, a retailer, and the loyalty program operator; wherein the electronic data processing system is configured to allow a consumer to enter at least one contest provided by the loyalty program operator, and the contest is independent of a state lottery and a retailer contest.

As used in the specification below, the following terms can have the following meanings:

A "concept" can refer to distinct understanding of a principle, business method, or opportunity, which a gaming services party can offer to a retail partner (e.g. Winner Awareness, "Stay 'n Play," Loyalty, and Promotions).

A "solution" can refer to a specific deliverable, physical or otherwise, to be distributed by a gaming services party to retail partners in a replicable and scalable method. (e.g. Winner's Board, Play Center or lottery play surface, "Stay 'n Play" or lottery transaction islands, player loyalty programs, winner awareness danglers and displays, etc.)

A "player loyalty program" can refer to an interactive, web-based, lottery or gaming loyalty program.

A "front end showcase" can refer to a package of solutions, physical and interactive, that a retailer or retail partner can receive as an initial installation from a gaming services party (e.g. physical fixtures, merchandising kits, systems for inventory optimization and management, and player loyalty programs).

A "physical fixture" can refer to any physical component developed and/or utilized by a gaming services party with one or more of the following: advertising capabilities, instant ticket display and/or dispensing capabilities, host lottery and/or retailer lottery related information.

An "On-Counter Play Center" can refer to branded instant ticket display and dispensing units which fit seamlessly onto the preexisting counter space on either side of a cash register. On-Counter Play Centers can deliver secondary and tertiary enhancements (e.g., a mistake ticket tree, play slips, player newsletters, winner awareness, etc.), and can calm any chaos present in a retail display area or counter.

An "In-counter spotlight" can refer to branded instant ticket promotion or display/dispensing unit which is built into or on top of the ticket dispensing area inside the in-counter point of service. This unit can be used at the point of sale or service to promote impulse instant ticket purchases. The dispenser can highlight and promote certain tickets, and create a feeling of luck and surprise.

An "On-counter spotlight" can refer to branded on-counter ticket displays, screens, or monitors, and can promote or highlight tickets located in alternate locations throughout the store (i.e., in-counter, waterfall, Lucite boxes, etc.) so that a customer can more clearly see any options. An "on-counter spotlight" also has the ability to hold promotional information regarding past winners and/or current jackpots.

A "Lucite box tower play center" can refer to branded tertiary enhancements to existing on counter Lucite box instant ticket displays. Design features can also include a ticket tree, winner awareness displays, play slip holders, player newsletter holders, promotion, and advertising.

A system, data processing system, and/or other device described as being "independent of," "independent from" or by an equivalent phrase refers to a system which does not openly share access to data with independent systems or devices; can use disparate computational equipment; can use disparate security and/or user access systems; is owned and operated by a separate entity; and/or is otherwise structurally and functionally separate from other systems configured to perform similar functions.

BRIEF DESCRIPTION OF THE DRAWINGS

These and other features of the disclosed apparatus will be more readily understood from the following detailed description of the various aspects of the apparatus taken in conjunction with the accompanying drawings that depict various embodiments of the invention, in which.

It is noted that the drawings are not necessarily to scale. The drawings are intended to depict only typical aspects of the disclosure, and therefore should not be considered as limiting its scope. In the drawings, like numbering represents like elements between the drawings.

DETAILED DESCRIPTION OF PREFERRED EMBODIMENTS

Figure 1A:
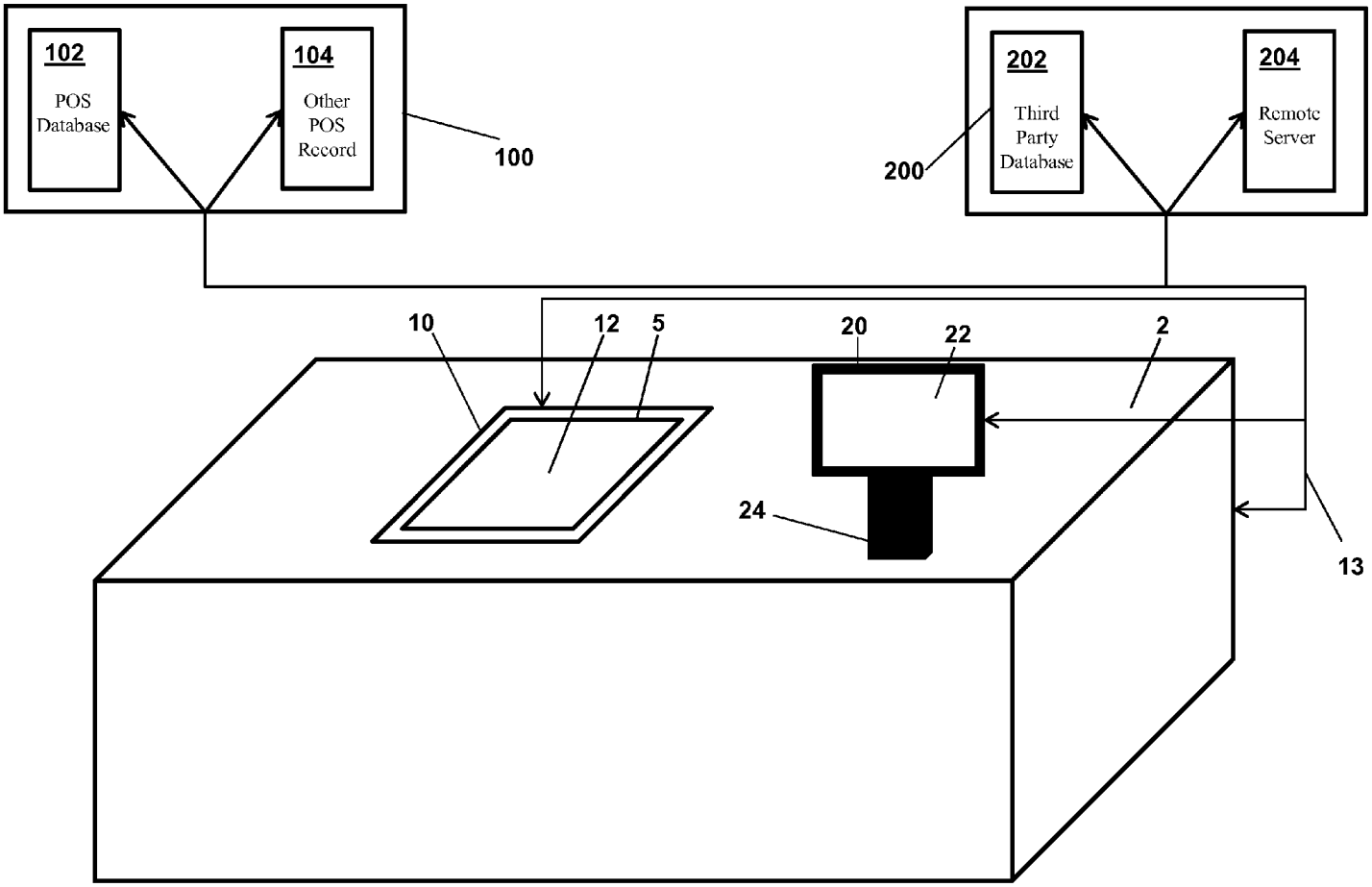
FIG. 1A is a perspective view and diagram of a retail gaming display according to an embodiment of the invention, which includes an insert and a countertop display, with a network access link to external and internal networks.

In the following description, reference is made to the accompanying drawings that form a part thereof, and in which is shown by way of illustration specific exemplary embodiments in which the present teachings may be practiced. These embodiments are described in sufficient detail to enable those skilled in the art to practice the present teachings and it is to be understood that other embodiments may be utilized and that changes may be made without departing from the scope of the present teachings. The following description is, therefore, merely exemplary.

When an element or layer is referred to as being "on," "affixed to," "disengaged from," "connected to," or "coupled to" another element or layer, it may be directly on, engaged, connected or coupled to the other element or layer, or intervening elements or layers may be present. In contrast, when an element is referred to as being "directly on," "directly affixed to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

I. Gaming Displays

Electronic and physical embodiments of retail lottery and gaming displays are contemplated in embodiments of the present disclosure. At a retail counter or similar point of sale or service, each area holding an instant ticket, picture of a winner, player loyalty program information, promotions advertisements, or a host state lottery promotion can include a digital screen displaying promotional information, or a transparent pocket containing a paper or physical display of the same or similar information. Thus, in electronic embodiments, a user responsible for operating a display can electronically change the information displayed by remotely accessing the display or a device governing the display form a remote system, computer, or other device. Furthermore, the information displayed on electronic embodiments of the contemplated gaming displays can change without on-site user input, e.g., via automatic updates provided remotely from a local network or the internet, as is described below in further detail.

Referring to the drawings, FIG. 1A provides an example point of service or retail location where the disclosed retail lottery and gaming displays can be used. A service point, depicted in the figure as countertop surface 2, invites a customer to interact with a store clerk, lottery or gaming salesperson, or a similar official. Countertop surface 2 can include an inset 10 at the countertop surface 2 or point of service to notify a customer of lottery and gaming offers. Inset 10 can define an inset cavity (not shown) through which electronic service display 5 can be affixed to countertop surface 2. In some embodiments, service display 5 can be flush with countertop surface 2. Inset 10 can include one or more dividing surfaces, such as translucent materials in layers or sheets, which can display items 12 such as lottery and gaming tickets or promotions to a customer while simultaneously preventing the customer from accessing the displayed items 12 without approval from a retail clerk or gaming service provider.

Items 12 can also be displayed virtually on an electronic service display 5 that provides lottery transaction information to a customer. If items 12 are shown as simulated representations on an electronic service display 5, the screen can be a closed circuit display or can be connected to either an internal network 100 or a remote network 200 through network access link 13. In some embodiments, the inset 10 can display items 12 directly to a customer without any dividing surfaces, such as translucent layers, separating the customer from electronic service display 5.

Options for lottery and gaming can additionally or alternatively be shown in countertop display 20, which can rest on countertop surface 2 and include a plastic box, screen, kiosk, or similar high-visibility fixture for displaying countertop items 22 such as physical lottery tickets or similar gaming opportunities. Countertop display 20 can also be affixed to countertop surface 2 by display member 24. Countertop display 20 can be made of plastic, glass, or a similarly durable material to prevent theft of countertop items 22. Countertop display 20 can further include a secure access point (not shown) through which a clerk or lottery gaming service provider can obtain countertop items 22 to provide them to a customer upon purchase.

Countertop display 20 can also include a screen which displays electronic versions of countertop items 22 or other information to promote lottery and gaming transactions. Similar to inset 10, countertop display 20 can be connected to internal network 100 or remote network 2. Inset 10 or countertop display 20 can be connected to internal network 100 directly or through countertop 2 by a network access link 13. Gaming and lottery data can be stored in or retrieved from a point of service or "POS" database 102, and/or other records 104 maintained by at the retail or point of service site. Alternatively, if the retailer or lottery service provider uses remote network 200 for data storage and retrieval, inset 10 and countertop display 20 can be connected through network access link 13 to third party database 202 or remote server 204. The retailer or lottery service provider thus has flexibility to store and retrieve data using proprietary databases and databases operated by other entities, including a state lottery operator, retailer, and/or loyalty rewards program operator.

In addition to sliding a tangible image or ticket in and out of a display pocket made of plastic or similar material, the present disclosure contemplates video screens, which can change images via an electronic process from within the retail store or connection to an off-site location. This limits the need for a display provider to make in-store visits to change the display, and reduces the number of employees that could otherwise be needed to update lottery or gaming promotions on-site. In addition, electronic displays accessible to remote parties and/or users allow the operator of a state lottery, retailer-specific loyalty rewards program, and/or independent loyalty rewards program to provide a uniform message to prospective customers at multiple sites.

Figure 1B:
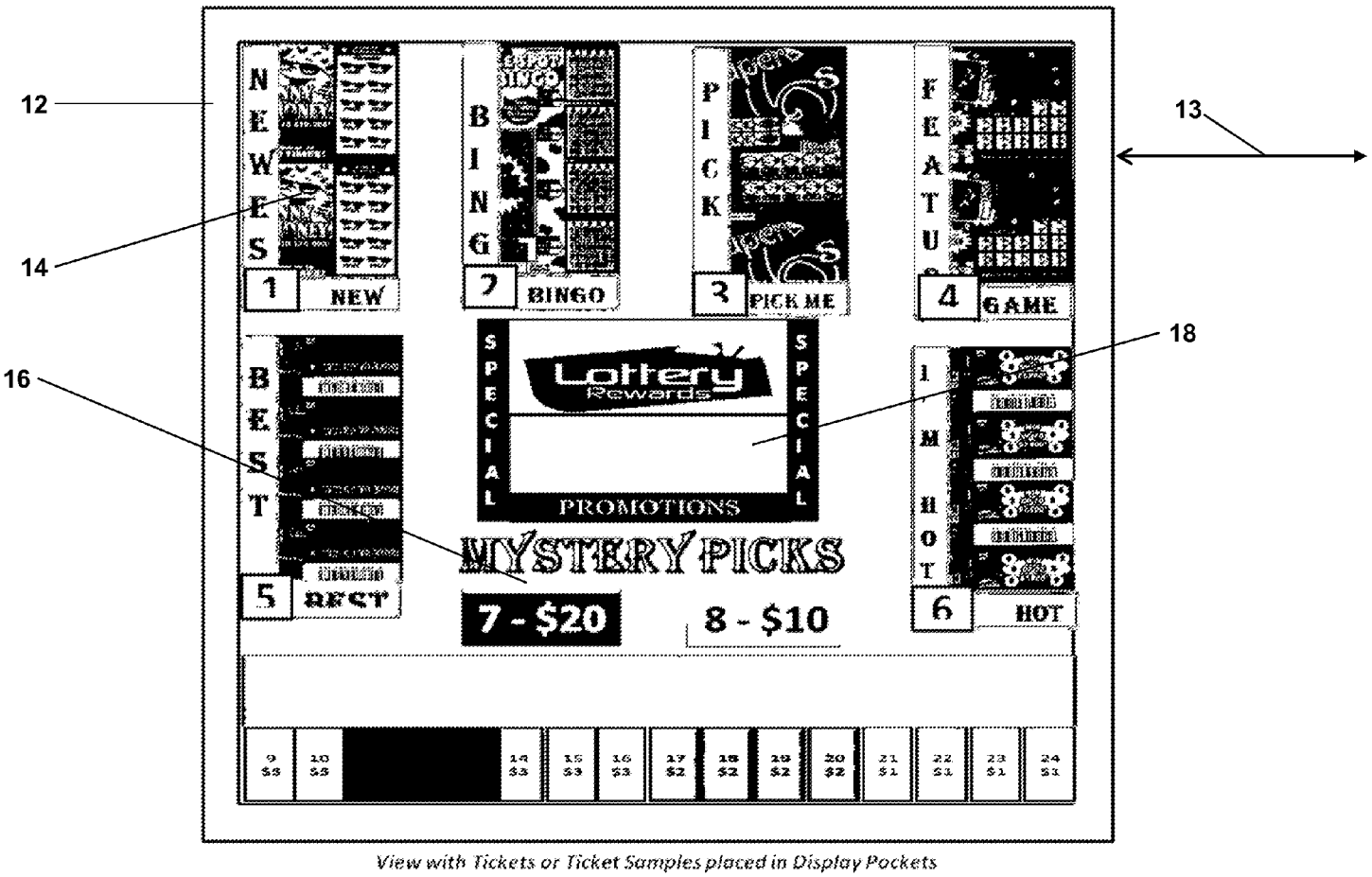
FIG. 1B depicts an example display of gaming and lottery items according to an embodiment of the invention.

Turning to FIG. 1B, a display of items 12 that can be used with inset 10 and/or countertop display 20 is shown. A display of items 12 can be known by a trade name such as "In-Counter Spotlight" or "On-Counter Spotlight" and can be a fixture which can be placed under or on top of POS and countertop areas, including glass and plastic areas, such as inset 10 or countertop display 20, and can have spotlighted tickets 14 around the perimeter.

A promotion space 18 can include information about a lottery rewards program, and can include a brand or loyalty program trademark as depicted in the accompanying figure. Promotion space 18 can include areas used for promotions as in addition to providing information about a lottery rewards incentive provider. A special offer area 16 can include bundles and promotions, such as a function for buying multiple tickets for the same game or different games. The disclosure further contemplates that the spotlighted tickets 14, special offer area 16, and promotion space 18 can be part of a single electronic screen or display, or several electronic displays, which can optionally be switched out and updated manually or automatically through by network access link 13.

A concept for an in-counter instant ticket dispenser top treatment provides a showcase at the retail counter or point of sale to promote impulse purchases. One version of this installation can be used in stores that have instant ticket vending machines that provide graphic images of all instant tickets available in a store. Another version of this installation promotes certain games and uses the available space of an inset to highlight and promote certain tickets, thereby creating a feeling of luck and surprise. To promote this feeling for the consumer, some tickets can be presented with names such as "mystery pick," "lucky dip," or a similarly named combination section 16 of inset 10. The ticket layout shown in FIG. 1B provides a simplified consumer presentation of tickets loaded in the dispenser trays.

In an example arrangement, the surface area of an in-counter dispenser or inset 10 for displaying items 12 can be twenty and one-quarter square inches. Instant tickets 14 are generally four inches wide, while their length may correspond to the ticket's price point. For example, a one dollar ticket may have a length of two inches while a two dollar ticket may be four inches long. The maximum ticket length is generally ten to twelve inches, but these ticket lengths are generally reserved for special promotions. More commonly, non-specialized tickets have a maximum length of eight inches.

The disclosed concept for an in-counter dispenser or inset 10 is based on these standards, such that the in-counter dispenser or inset 10 may include two pieces of clear plastic (Lexan) or glass that provide an envelope in which displayed tickets or items 12 are placed and sandwiched in a specific display area. Alternatively, the in-counter dispenser may include an electronic screen, which is connected to local network 100 or remote network 200 for automatic and/or manual updates.

In one embodiment, the concept includes game dispenser 24, which displays six tickets 14. The displayed tickets, sample tickets, or electronic ticket representations 14 are placed in an appropriate placeholder pocket or screen area for display to consumers as items 12. These pockets or screen sections are thus four inches wide and eight inches tall. This size can accommodate all tickets by width and can include four two inch tickets, two four inch tickets, and one six or eight inch ticket. The specially promoted tickets at combination section 16 can be placed in pockets or small sub-sections, and each sub-section can be color coded by the price point of the ticket or group of tickets in the corresponding portion of a dispenser.

Figure 2:
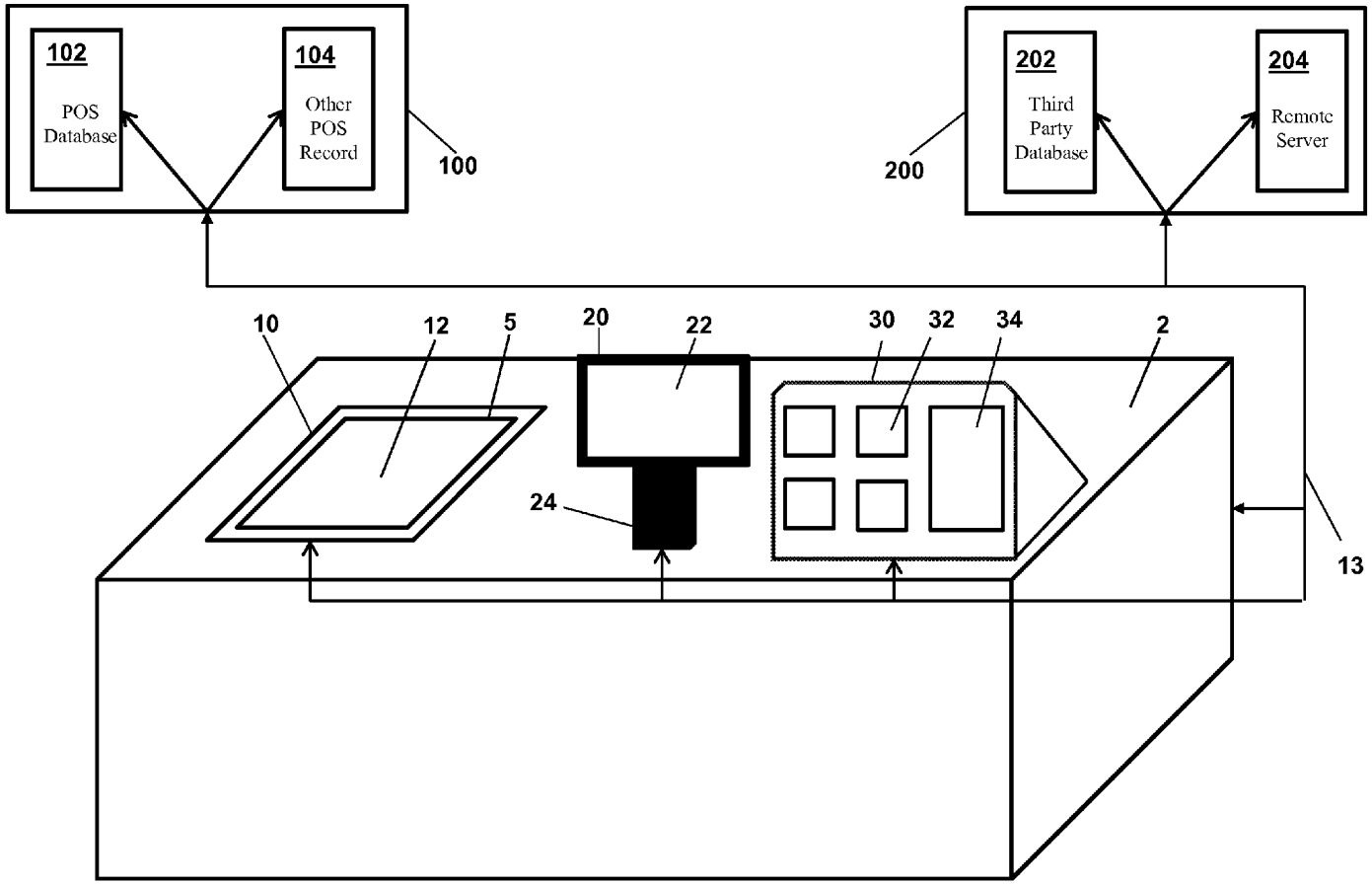
FIG. 2 is a perspective view and diagram of a retail gaming display according to an embodiment of the invention, which can include an insert, countertop display, and a winner awareness display, with a network access link to internal and/or external networks.

In FIG. 2, a retail or point of service area at countertop surface 2 is shown. This embodiment can also include a winner awareness display 30, which can be located on countertop surface 2 or otherwise displayed at an area that a customer is likely to see. Winner awareness display 30 can be deployed in addition to or alternatively from inset 10 and countertop display 20. Winner awareness display 30 can include winner portraits 32 which can be physical or electronic representations of previous lottery or game winners. Though winner awareness display 30 is depicted as including four winner portraits 32, any number of winner portraits 32 (e.g. six, eight, ten, twenty, etc. winner portraits 32) can be used on winner awareness display 30, and the number of portraits can increase when winner portraits 32 are electronic and changed through a time-cycled display process.

In addition, winner awareness display 30 can include a promotional area 34, which can be an electronic screen, digital display, or physical promotion space (such as a whiteboard) for highlighting lottery and gaming opportunities. Winner awareness display 30 can be connected, through network access link 13 to internal network 100 or external network 200 for automatic and manual updates where winner awareness display 30 includes one or more electronic screens. Winner awareness display 30 can be provided with a name to raise consumer awareness and attract prospective customers, such as "Winners Circle Play Center," "Winners Circle Info Board," "Stay N' Play Island," etc.

Figure 3:
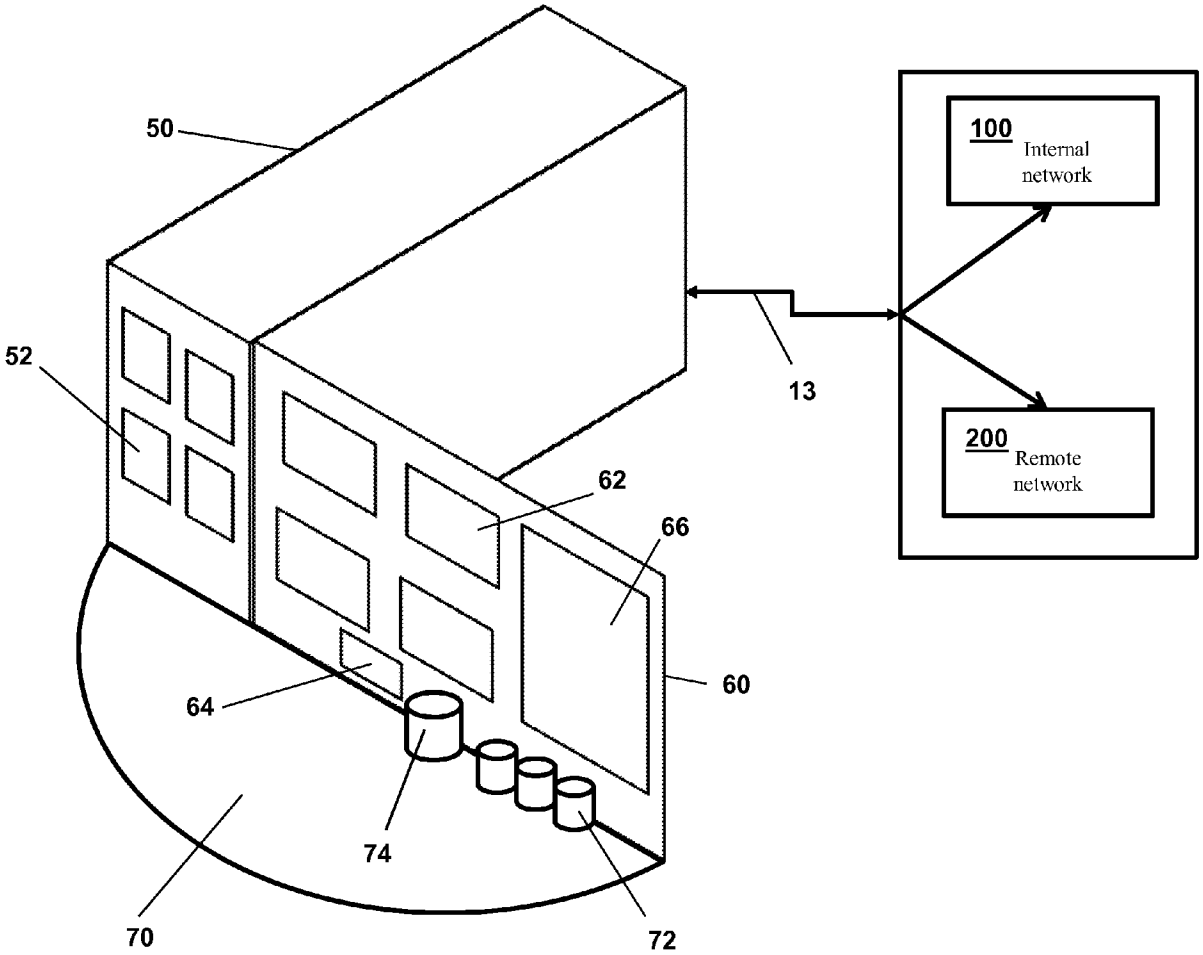
FIG. 3 is a perspective view and diagram of a retail gaming display according to an embodiment of the invention, with network connections which includes a gaming service area, a winner awareness display, a gaming message display, and a game play surface.

FIG. 3 provides a perspective diagram of a lottery sale or point of service area, including a service display area 50 coupled to a gaming play surface 70 and winner awareness display 60. Any or all of these components can be connected through network access link 13 to internal network 100 and/or remote network 200. Service display area 50 can include a physical or electronic showcase of gaming opportunities 52, which can include tickets, promotions, and special offers. Gaming opportunities 52 can include physical slips displayed behind a transparent display, such as a glass or plastic display, or can be electronic or digital screens configured to communicate lottery or gaming opportunities to customers by images, videos, touch screens, virtual tickets, and similar visual cues.

Gaming play surface 70 can be coupled to service display area 50. Gaming play surface 70 offers gaming customers an area at which they can immediately enter lottery contests by filling out slips or lottery cards (not shown) with personal writing implements or writing implements provided in writing implement containers 72 connected to gaming play surface 70. Gaming play surface 70 can also include entry slip dispenser 74. Entry slip dispenser 74 can include gaming play tickets capable of being used or entered by a gaming consumer at a retail counter or point of service. Entry slip dispenser 74 can be affixed to gaming play surface 70, winner awareness display 30, and/or service display area 50. Although writing implement containers 72 and gaming slip dispenser 74 are depicted in FIG. 3 as having a cylindrical shape, any three-dimensional geometry capable of holding a writing implement is contemplated.

Winner awareness display 60 can also be coupled to one or both of lottery play surface 70 and ticket display device 50. Winner awareness display 60 can include further features to attract customers and invite them to participate in a gaming or lottery transaction. For instance, a logo display area 64 can include a trademark or brand for a business that offers one or more player loyalty programs. Logo display area 64 can include physical items used to alert customers to the existence of a loyalty program for gaming transactions, and can also include an electronic screen capable of communicating information about a player loyalty program, and can be updated manually and/or electronically by connection to internal network 100 or remote network 200. Thus, logo display area 64 can include information such as recent winners of state lotteries, retailer drawings and/or promotions, and/or promotions by independent lottery rewards loyalty programs.

Winner awareness display 60 can further include winner portraits 62, which can be physical or electronic representations of previous lottery or game winners for particular contests or given retail site. Winner awareness display 60 can further include winner promotion space 66, which can offer further information or rewards to consumers at a retail establishment or point of service. The winner promotion space can also be displayed as an electronic, digital, or touch screen connected to internal network 100 and/or external network 200 through network access link 13. Connecting an electronic winner promotion space 66 to any network allows the space to be updated manually or automatically with current information relevant to any number of games or lotteries.

II. Gaming Loyalty System

Embodiments of the disclosure also include a comprehensive and independent loyalty rewards program, particularly suitable for prospective lottery consumers. A lottery rewards program according to the present disclosure can be independent of state-operated lotteries and/or rewards programs operated by particular retailers. Embodiments of the present disclosure can offer lottery consumers the opportunity to redeem benefits or enter into second chance drawings, based on a complete record of their previous activity as lottery or gaming consumers, without being limited by a specific lottery, retail establishment, and/or retailer-offered lottery rewards program.

The rewards offered by programs according to embodiments of the present disclosure can also track layers of activity, including a consumer's frequency of visiting particular retailers, and participation in certain state lotteries, in order to provide a comprehensive rewards package to consumers. In some embodiments, the rewards program can include methods and/or algorithms for determining a level of customer loyalty based on several variables, and offering incentives to customers who meet or exceed a predetermined number of tickets purchased and/or dollars spent. As described herein, these algorithms and methods can be executed with a computing device connected to a local and/or remote network.

Figure 4:
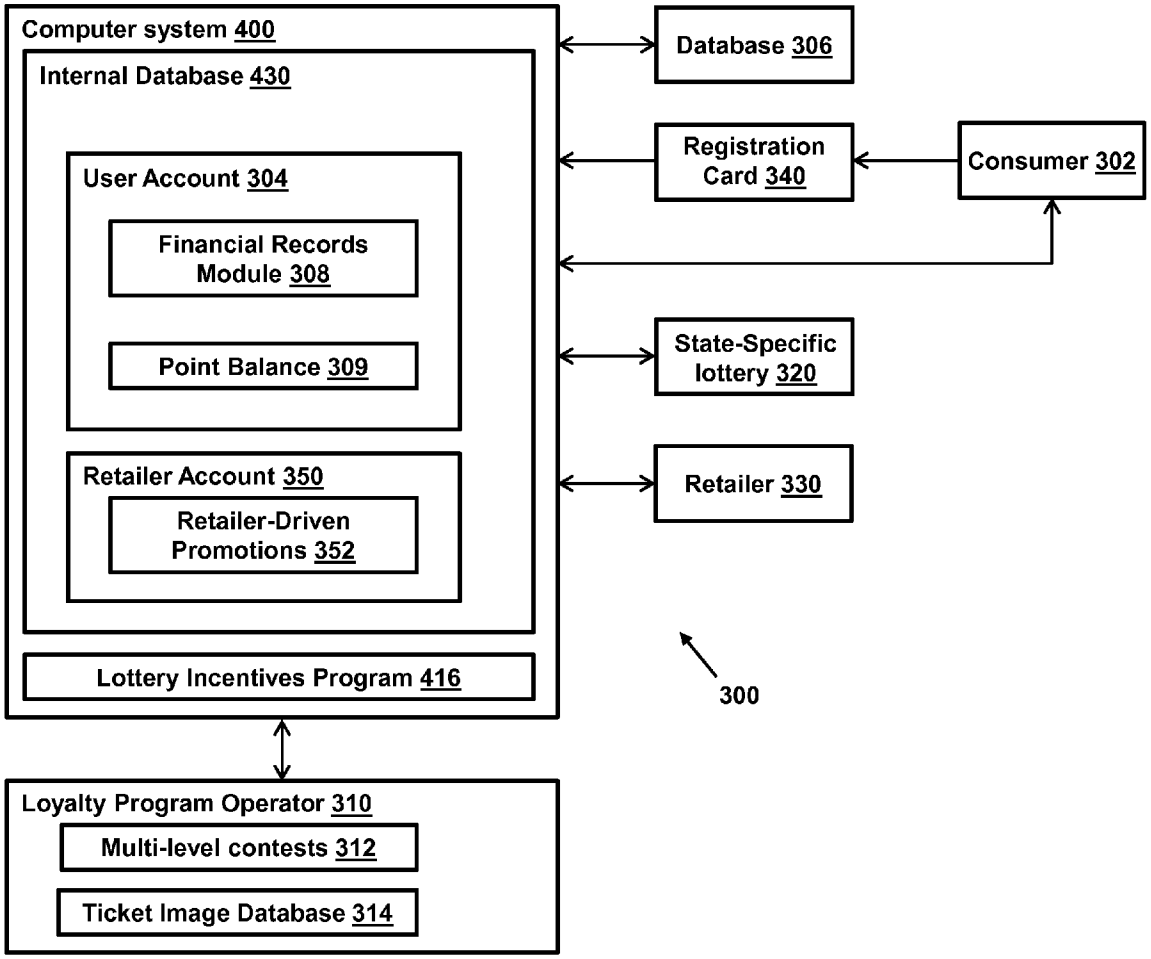
FIG. 4 is an organizational diagram of a consumer gaming rewards system according to an embodiment of the invention.

Turning to FIG. 4, a representative organization of a consumer gaming loyalty system 300 is shown. In some embodiments of the disclosure, a consumer 302 can create a user account 304, which can be stored in a data processing system such as a computer system 400, and/or within an internal database 430 of computer system 400. User account 304 can further be saved in a separate electronic database 306 in communication with computer system 400. As discussed elsewhere herein, computer system 400 can also include a lottery incentives program 416 for executing steps (e.g., reading and/or writing data in) related to user account 304 and/or other data stored in database 306 and/or internal database 430. It is therefore understood that the various steps and functions performed herein can be performed with software instructions of lottery incentives program 416. Consumer 302 can register for or log into user account 304, e.g., by connecting to a website or a place of service where consumer 302 can interact with loyalty service operator 310. In an illustrative example, consumer 302 can register for user account 304 on computer system 400 available at a particular retail site or point of service, such as a grocery store, convenience store, etc. Through user account 304, consumer 302 can access a record of his or her previous lottery and gaming transactions for state-specific lotteries, retailer-specific lotteries or drawings, and/or other related transactions. In embodiments of the invention, consumer 302 can access user account 304 in multiple ways, including, e.g., online with a browser or dedicated application on a computer (e.g., computer system 400), tablet, phone, electronic kiosk, or other device that includes an internet connection, which can be owned personally by consumer 302 and/or by a retailer or rewards program operator.

According to embodiments of the disclosure, user account 304 can track lottery and gaming transactions in several different states and/or countries, with the same user account 304 offering incentives to consumer 302 regardless of where he or she chooses to participate in other lotteries or lottery rewards programs. Similarly, user account 304 can record transactions or activities by consumer 302 at different retail locations and franchises. Consumer gaming loyalty systems 300 in embodiments of the present disclosure may be promoted in partnership with retailer-specific or state-specific loyalty programs, or may be completely independent of other lottery rewards programs.

To facilitate consumer loyalty and incentives for creating user account 304, consumer gaming loyalty system 300 can allow a loyalty program operator 310 to collect data from state-specific lotteries 320 and retailers 330. State-specific lotteries 320 and/or retailers 330 may administer or include independent data processing systems, such as other computer systems or devices. For simplicity, references to state-specific lotteries 320 and/or retailers 330 can also be construed as referring to data processing systems owned and/or operated by these entities. Loyalty program operator 310 can include a party which maintains computer system 400 and/or user account 304 independently from state-specific lotteries and/or retailers 330. This information can be provided, e.g., by consumer 302 submitting a record (receipt, serial number, individual ticket, etc.) to loyalty program 310 when connecting to user account 304. User account 304 can be an integrated source of all past lottery transactions for consumer 302 which includes information pertaining to past entries in a state-specific lottery 320, previous transactions and retailer-provided rewards points offered by retailer 330, and/or reward or incentive programs provided by loyalty program operator 310. User account 304 can store identifying information for consumer 302 in order to provide a secure portal for consumer gaming loyalty system 300. For example, user account 304 can include a user name, password, and similar identifying details for consumer 302. In other embodiments, computer system 400 on which user account 304 is stored send a verification email or code to consumer 302, which can be used to verify registration, detect fraud and/or request additional information from consumers 302.

Providing user account 304 for consumer 302 with an integrated record of all lottery and gaming transactions offers advantages not available in other second chance drawings and point-based incentives. For example, user account 304 can include a financial records module 308, through which consumer 302 can access his or her total dollar amount of lottery purchases to promote financial planning, financial education, financial literacy, and/or provide a source for determining lottery expenses for tax deductions and claims for reimbursement. User account 304 can include other related types of information, such as real-time information regarding retailer sales, promotions, etc. Thus, user account 304 can enhance a lottery or gaming experience for consumer 302 and/or increasing loyalty for particular consumer gaming loyalty system 300.

User account 304 can include a point balance 309 based on a record of transactions of consumer 302 recorded in financial records module 308. Points for consumer 302 can be assigned to a corresponding user account 304 according to any desired method, process, etc. set by the operator of a lottery rewards program. Points can be assigned, e.g., based on the dollar value of a transaction, the number of times in which consumer 302 purchases lottery tickets, a number of ticket purchases from predetermined state-specific lotteries 320 and/or retailers 330, etc. Point balance 309 can increase the loyalty of consumer 302 by allowing consumer 302 to enter additional drawings by loyalty program operator 310, offering sales, rebates, etc., for new tickets, enter pools or second chance drawings, and/or participate in other promotions.

User account 304 can also record transaction frequency information pertaining to loyalty program operator 310, state-specific lotteries 320, and/or retailers 330, either directly from each source or indirectly through loyalty program operator 310. In addition, user account 304 can include various personalization and security features, including user names, passwords, the ability to be accessed remotely by phones and similar devices, and encoding relevant information which can be accessed and downloaded in a portable document format, etc.

By accessing information recorded in user account 304, e.g., financial records module 308, loyalty program operator 310 can offer multi-level contests 312 to consumer 302. The term "multi-level" refers to lotteries, contests, drawings, raffles, etc., which can be linked to or independent from state-specific lotteries 320 and promotions offered by retailer 330. In some embodiments, multi-level contests 312 can include periodic (e.g. quarterly, monthly, weekly, etc.) "second chance" contests in which consumer 302 is entered into further games, which can be a sweepstakes, a raffle, a lottery, a random drawing, or other games of chance. Multi-level contests 312 can allow consumer 302, through user account 304, to be rewarded for participating in several lottery transactions or meeting certain criteria, such as participating in a predetermined number of transactions within a particular time interval.

Multi-level contests 312 can include multiple draws for one consumer 302 at frequencies such as yearly, quarterly, monthly, and/or weekly contests. Multi-level contests 312 can be available to all consumers 302 with a user account 304, regardless of their home state, which state-specific lotteries 320 in which they have participated, and/or retailers 330 where consumers 302 have purchased tickets. The ability for consumer 302 to access multi-level contests 312 can optionally depend on their point balance 309. In some embodiments, prizes in multi-level contests 312 can be funded by program operator 310 and/or retailer 330. Multi-level contests 312 can be operated simultaneously with drawings offered by state-specific lottery 320 and/or retailers 330. Thus, consumer gaming loyalty system 300 can provide multi-level contests 312 in which consumers 302 from multiple lotteries and geographic areas are entered into a single event or group of events.

Consumer gaming loyalty system 300 can allow consumer 302 to access point balance 309, which can be used and manipulated in ways similar to a balance of money. For example, points in point balance 309 can be viewed, increased, deducted or spent, transferred, etc. Some embodiments of consumer gaming loyalty system 300 can therefore provide a consumer-driven rewards system. For example, consumer 302 can view his or her current point balance 309 by accessing user account 304. Several multi-level contests 312 or other promotions can be offered simultaneously by loyalty program operator 310, which can require consumer 302 to spend a portion of point balance 309. Thus, consumer 302 can deposit or withdraw points within point balance 309 as desired, and participate in multi-level contests 312 according to his/her discretion.

Consumer gaming loyalty system 300 can also serve the additional function verifying lottery tickets and/or preventing fraud by including a ticket image database 314. Through consumer gaming loyalty system 300, loyalty program operator 310 can request for consumers 302 to verify their transactions by uploading tickets, receipts, serial numbers, and/or other records to user account 304. This functionality can capture some or all of the following information, if available: an ID number for user account 304, a transaction date, a price point, an assigned point value, a game title or number, a ticket category, and/or a scanned image of a state-specific, retailer-specific, or other lottery ticket.

In some embodiments, consumer gaming loyalty system 300 can include a registration card 340, one or more of which can be provided to consumer 302 by loyalty program operator 310, state-specific lottery 320, and/or retailer 330. Registration card 340 can be the same document as a lottery or gaming ticket, receipt, etc., or can be a separate item. Registration card 340 can invite consumer 302 to create user account 304 and/or enter information into centralized financial management system 308 by being furnished to consumer 302 after a lottery transaction has occurred. Consumer 302 can use registration card 340 by entering a code on a website listed on the card, or by presenting the card to loyalty program operator 310, state-specific lottery 320, and/or retailer 330.

In some embodiments, registration card 340 can include a receipt obtained from a lottery or gaming transaction, on which identifying information such as a code can be printed. Consumer 302 can redeem registration card 340 at a specially-designed kiosk or online via a website by entering the code or similar information, and user account 304 can store and validate information from consumer 302. This embodiment can allow user account 304 to be created for consumer 302 automatically if consumer 302 has not previously registered to participate in consumer gaming loyalty system 300. In addition, loyalty program operator 310 can offer benefits to consumer 302 immediately upon registration card 340 being used to create user account 302, thereby inviting consumer 302 to participate in additional gaming lottery transactions and/or multi-level contests 312.

Lottery registration card 340 can also be used to detect and identify fraudulent transactions or code redemptions. In some embodiments, computer system 400 can identify an IP address for when consumer 302 accesses user account 304. User account 304 can then monitor the number of redemptions provided from the identified IP address, and then decline further service after the number of redemptions meets or exceeds a maximum amount. In addition, the records stored in user account 304 allows any of loyalty program operator 310, state-specific lottery 320, and/or retailer 330 to view consumer entries and redemptions, and scan for any suspicious activity.

Consumer gaming loyalty system 300 can also include a retailer account 350 (e.g., stored within the same computer system 400 and/or internal database 430 as user account 304 or an independent computer system 400 with a different internal database 430) which can act as an intermediary component between retailer 330 and user account 304. Retailer 300 can optionally create or access retailer account 350 via computer system 400 (which can be the same computer system 400 accessed by consumer 304 or a different computer system), which can further be configured to interact with user account 304. When retailer 330 wishes to create retailer account 350, it can do so by interaction with loyalty program operator 310. Through retailer account 350, retailers 330 can become a "designated retailer" for consumers 302, allowing retailer 330 to deliver retailer-driven promotions 352 to consumers 302 through their corresponding user account 304. As used herein, the term "designated retailer" denotes a retailer chosen by consumer 302 as a preferred vendor or source for purchasing lottery tickets or lottery-related items, and/or a vendor through which consumer 302 has an independent gaming loyalty or promotional account. For example, retailer-driven promotions 352 can include second chance drawings, and correspondence between retailer 330 and consumer 302 can be driven by interaction between retailer account 350 and user account 304 through electronic correspondence such as account messages to user account 304, emails, text messages, windows, and similar methods for communicating with consumer 302.

Where consumer 302 designates retailer 330 as a designated retailer, consumer gaming loyalty system can information such as the nearest participating location of the designated retailer 330 to consumer 302 through a zip code, coordinates, or similar information. Providing a retailer account 350 thus allows retailers 330 to adapt consumer gaming loyalty system 300 for use with new or existing retailer-driven promotions 352, and provide additional incentives to consumer 302 for participating in lottery or gaming transactions. In addition, the identification and fraud detection features previously discussed with respect to user account 304 can be integrated with or provided in addition to retailer account 350.

Figure 5:
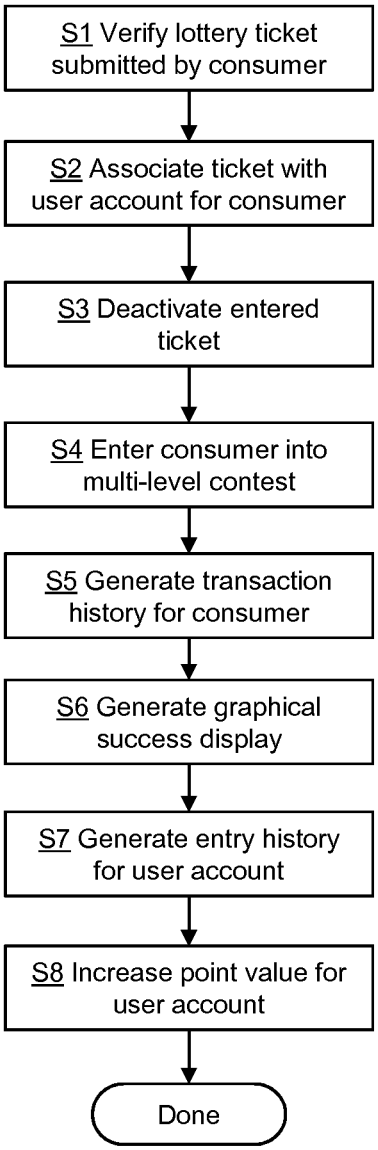
FIG. 5 is a flow diagram of a method according to an embodiment of the invention.

Referring to FIGS. 4 and 5 together, an illustrative flow diagram of methods according to the present disclosure is shown. The example method steps disclosed herein can be implemented, e.g., by software instructions encoded on or accessible to computer system 400 and one or more of the parts thereof discussed elsewhere herein. Although steps S1-S8 of FIG. 5 are shown as occurring in sequential order, it is understood that steps S1-S8 can be carried out in an alternative order where desired and applicable. It is further understood that one or more of the steps shown in FIG. 5 and discussed herein can be omitted where desired.

In step S1, computer system 400 can verify a lottery ticket submitted by consumer 302. In an example embodiment, consumer 302 can submit the lottery ticket to electronic database 306 and/or computer system 400, each of which can be independent of a state lottery and/or a retailer-specific lottery contest for which the verified ticket is used. The "ticket" verified in step S1 can be a physical ticket or more broadly can include any physical or electronic item representing a single entry into a state lottery or retailer-specific loyalty drawing or contest (e.g., a ticket to participate in a retailer-specific rewards drawing). In any case, a lottery ticket can be verified in step S1 by reference to a physical ticket, an electronic ticket (e.g., an electronically stored transaction record), a physical or electronic receipt, a ticket serial number, and/or other currently known or later developed processes for verifying a single transaction or lottery entry. Embodiments of the present disclosure can verify a lottery ticket by, e.g., using an optical scanner operated by consumer 302 and/or retailer 330 to convert a particular ticket into an image which can be scanned for identifying information (ticket number, entry numbers, etc.).

In step S2, computer system 400 can associate the verified ticket with a particular user account 304 stored, e.g., within electronic database 306. As discussed elsewhere herein, user account 304 can be part of a consumer gaming loyalty system 300 and/or stored on an electronic database 306 which is operated independently of a retailer-specific lottery and/or a state-specific lottery. To associate the verified lottery ticket with user account 304, user account 304 can be created in step S2 after the lottery ticket is verified, or the details of the transaction can be submitted to and stored within user account 304. As discussed herein, user account 304 can include a record of transactions for purchasing tickets from state-specific and retailer-specific lotteries even though electronic database 306 is operated by a party independent of a state lottery program and/or retailer loyalty program. To prevent fraud, duplication, or attempted ticket re-use, the method can proceed to step S3 where the verified ticket is marked off within electronic database 306 (i.e., deactivated) to prevent additional redemptions by the same user or other users. Marking off the verified ticket in step S3 can include, e.g., moving data or signifiers for the ticket from a list of unredeemed tickets to a list of redeemed tickets elsewhere in electronic database 306 and/or computer system 400.

Methods according to the present disclosure can create an incentive for consumer 302 to submit his or her transaction details to user account 304 by, e.g., entering consumer 302 into multi-level contest 312 in step S4. Multi-level contest 312 can be an additional lottery, drawing, or other type of contest which is operated independently of a state-specific lottery 320 or a retailer-specific lottery. The entry of consumer 302 into multi-level contest 312 can be conditioned upon the lottery ticket being verified in step S1 and the ticket being associated with user account 304 in step S2 without being previously verified by consumer 302 or another party. Consumer 304 may earn cash prizes or other types of rewards in step S4 after being entered into multi-level contest 312, and it is further understood that the chances of winning for consumer 302 can increase by multiple, distinct lottery tickets being verified in step S1 to create multiple entries for the same consumer 302 in step S4.

Processes according to the present disclosure can also include computer system 400 generating a transaction history for consumer 302 in step S5. The transaction history generated in step S5 can be stored in user account 304 for access by consumer 302 and can include, e.g., past entries in state lotteries, past entries in retailer lotteries, past entries in independent lotteries (e.g., lotteries managed and provided by loyalty program operator 310), an amount of money spent on lottery tickets, etc. In some embodiments, the method disclosed herein can be provided to consumers 302 located in several states or geographic areas. Thus, the transaction history generated in step S5 can include transactions for two or more state-specific lotteries and/or transactions for two or more retailer-specific lotteries or rewards programs. All or part of the transaction history generated in step S5 can be made available to a state lottery operator and/or a retailer, where applicable and if authorized by consumer 302. Other aspects of user account 304 can also be accessible to loyalty program operator 310, state-specific lottery 320, and/or retailer 330 to provide cross-promotions and/or integration between consumer gaming loyalty system 300 and other existing loyalty systems or programs. In addition or alternatively, the transaction history generated in step S5 can be converted into an "entry history" for tracking participation in particular lotteries by user account 304, as discussed elsewhere herein.

The flow discussed herein can also include generating a graphical success display for consumer 302 in step S6. The graphical success display can provide a visual guide (e.g., an interactive or non-interactive chart, graph, geographic map, etc.) with one or more real-time pieces of information related to the verified lottery ticket and/or other contests provided to consumer 302, such as multi-level contest 312. Information provided to consumer 302 in the generated graphical success display can include a percent chance of success based on tickets purchased, the names of winning entrants for drawings in which consumer 302 is participating or is not participating, a date and time when state-specific lottery drawings, retailer-specific lottery drawings, and/or independent lottery drawings (e.g., multi-level contests 312 operated by loyalty program operator 310) are scheduled.

In step S7, computer system 400 can also generate an entry history for user account 304. The generated entry history may be separate from the transaction history generated in step S5, and may include, e.g., a rate of successful tickets for state-specific lotteries, retailer-specific lotteries, and/or independent lotteries. The generated entry history for user account 304 may include a number of times that consumer 302 has purchased a ticket from a particular retailer or a particular state-specific lottery, and may be provided as an alternative summary of information to loyalty program operator 310, state-specific lottery 320, and/or retailer 330 instead of the generated transaction history. The entry history for user account 304 can also be provided to consumer 304 to summarize their previous winnings from other drawings.

The flow can also include increasing point balance 309 of user account 304 in step S8. Increasing point balance 309 can occur after a lottery ticket from consumer 302 is successfully verified in step S1. As discussed elsewhere herein, user account 304 can include point balance 309 to reward consumer 302 for purchasing several lottery tickets or by buying a particular number of tickets from a promoted retailer 330. Computing device 400 can increase a number of points for consumer 302 in user account 304 to encourage particular purchases or behaviors, and to provide additional incentives. Consumer 302 may redeem or otherwise use points from point balance 309 via embodiments of consumer gaming loyalty system 300 in separate methods or processes.

The embodiments discussed in this disclosure offer several technical and commercial advantages. One advantage that can be recognized from an embodiment of the disclosure is that updates to lottery and gaming displays at retail sites or points of sale can be performed through access to internal and external networks. This eliminates any need for an off-site person or gaming service employee to change manually the information presented at each store. Furthermore, an embodiment of the disclosure can generate greater awareness of lottery and gaming opportunities to customers, and thereby increase revenues at retail sites, points of service, and points of sale. Other embodiments are capable of increasing consumer loyalty by providing incentives for a customer to continue purchasing gaming and lottery tickets.

Figure 6:
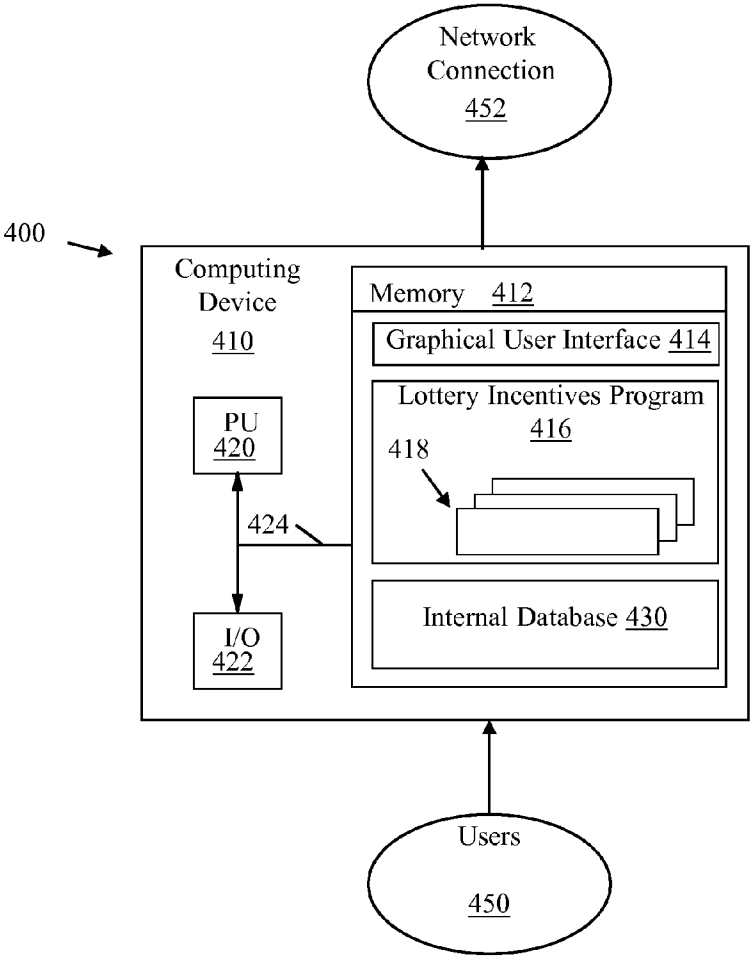
FIG. 6 is an illustrative environment which includes a computer system for implementing embodiments of the present disclosure.

FIG. 6 shows a detailed illustration of an example computer system 400 which can be used for creating and/or accessing user accounts 304 or retailer accounts 350 (shown previously in FIG. 4) according to embodiments of the invention. To this extent, computer system 400 can include a computing device 410 with memory 412 that can perform a process described herein in order to create and access accounts. In particular, computer system 400 is shown to include graphical user interface 414 and lottery incentives program 416 with associated modules 418, which allows computer system 400 to access lottery and gaming incentives functions by performing processes described herein.

Computer system 400 is shown to include processing unit 420 (e.g., one or more processors, memory 412 (e.g., a storage hierarchy), an input/output (I/O) device 422 (e.g., one or more I/O interfaces and/or devices), and a communications pathway 424. In general, processing unit 420 executes program code, such as lottery incentives program 416, which is at least partially fixed in memory 412. While executing program code, processing unit 420 can process data, which can result in reading and/or writing transformed data from/to memory 412 and/or I/O device 422 for further processing. Pathway 424 provides a communications link between each of the components in computer system 400. I/O device 422 can comprise one or more human I/O devices, which enable a plurality of users 450 to interact with computer system 400 and/or one or more communications devices to enable system users 450 to communicate with computer system 400 using any type of communications link. To this extent, lottery incentives program 416 can manage a set of interfaces (e.g., graphical user interface(s) 414, application program interface, and/or the like) that enable human and/or system users 450 to interact with lottery incentives program 416. Further, lottery incentives program 416 can manage (e.g., store, retrieve, create, manipulate, organize, present, etc.) the data through internal database 430 or any other solution.

In some embodiments, computer system 400 can include network connection 452, which can allow computer system 400 to communicate with other devices on internal and remote networks 100, 200 (FIGS. 1A, 2, 3). Network connection can thus be configured to send data to and/or receive data from computer system 400. Data received through network connection 452 can be stored in memory 412 and its subcomponents, and more specifically can be transmitted to lottery incentives program 416 and/or internal database 430.

In any event, computer system 400 can comprise one or more general purpose computing articles of manufacture (e.g., computing devices 410) capable of executing program code, such as lottery incentives program 416, installed thereon. As used herein, it is understood that "program code" means any collection of instructions, in any language, code or notation, that cause a computing device having an information processing capability to perform a particular action either directly or after any combination of the following: (a) conversion to another language, code or notation; (b) reproduction in a different material form; and/or (c) decompression. To this extent, lottery incentives program 416 can be embodied as any combination of system software and/or application software.

Further, lottery incentives program 416 can be implemented using a set of modules 418. In this case, a module 418 can enable computer system 400 to perform a set of tasks used by lottery incentives program 416, and can be separately developed and/or implemented apart from other portions of lottery incentives program 416. As used herein, the term "component" means any configuration of hardware, with or without software, which implements the functionality described in conjunction therewith using any solution, while the term "module" means program code that enables a computer system 400 to implement the actions described in conjunction therewith using any process. When fixed in memory 412 of a computer system 400 that includes a processing unit 420, a module is a substantial portion of a component that implements the actions. Regardless, it is understood that two or more components, modules, and/or systems may share some/all of their respective hardware and/or software. Further, it is understood that some of the functionality discussed herein may not be implemented or additional functionality may be included as part of computer system 400.

When computer system 400 comprises multiple computing devices, each computing device can have only a portion of lottery incentives program 416 fixed thereon (e.g., one or more modules 418). However, it is understood that computer system 400 and lottery incentives program 416 are only representative of various possible equivalent computer systems that may perform a process described herein. To this extent, in other embodiments, the functionality provided by computer system 400 and lottery incentives program 416 can be at least partially implemented by one or more computing devices that include any combination of general and/or specific purpose hardware with or without program code. In each embodiment, the hardware and program code, if included, can be created using standard engineering and programming techniques, respectively.

Regardless, when computer system 400 includes multiple computing devices, the computing devices can communicate over any type of communications link. Further, while performing a process described herein, computer system 400 can communicate with one or more other computer systems using any type of communications link. In either case, the communications link can comprise any combination of various types of optical fiber, wired, and/or wireless links; comprise any combination of one or more types of networks; and/or utilize any combination of various types of transmission techniques and protocols.

While shown and described herein as a method and system for sending and receiving encrypted messages, it is understood that aspects of the invention further provide various alternative embodiments. For example, in one embodiment, the invention provides a computer program fixed in at least one computer-readable medium, which when executed, enables a computer system to send and receive encrypted messages. To this extent, the computer-readable medium includes program code, such as lottery incentives program 416, which implements some or all of a process described herein. It is understood that the term "computer-readable medium" comprises one or more of any type of tangible medium of expression, now known or later developed, from which a copy of the program code can be perceived, reproduced, or otherwise communicated by a computing device. For example, the computer-readable medium can comprise: one or more portable storage articles of manufacture; one or more memory/storage components of a computing device; paper; and/or the like.

In another embodiment, the invention provides a method of providing a copy of program code, such as lottery incentives program 416, which implements some or all of a process described herein. In this case, a computer system can process a copy of program code that implements some or all of a process described herein to generate and transmit, for reception at a second, distinct location, a set of data signals that has one or more of its characteristics set and/or changed in such a manner as to encode a copy of the program code in the set of data signals. Similarly, an embodiment of the invention provides a method of acquiring a copy of program code that implements some or all of a process described herein, which includes a computer system receiving the set of data signals described herein, and translating the set of data signals into a copy of the computer program fixed in at least one computer-readable medium. In either case, the set of data signals can be transmitted/received using any type of communications link.

In still another embodiment, the invention provides a method of generating a system for creating and accessing user and retailer accounts (304, 350, FIG. 4) in a consumer gaming incentives system (300, FIG. 4). In this case, a computer system, such as computer system 400, can be obtained (e.g., created, maintained, made available, etc.) and one or more components for performing a process described herein can be obtained (e.g., created, purchased, used, modified, etc.) and deployed to the computer system. To this extent, the deployment can comprise one or more of: (1) installing program code on a computing device; (2) adding one or more computing and/or I/O devices to the computer system; (3) incorporating and/or modifying the computer system to enable it to perform a process described herein; and/or the like.

Aspects of the invention can be implemented as part of a business method that performs a process described herein on a subscription, advertising, and/or fee basis. That is, a service provider could offer to send and receive encrypted messages as described herein. In this case, the service provider can manage (e.g., create, maintain, support, etc.) a computer system, such as computer system 400, that performs a process described herein for one or more customers. In return, the service provider can receive payment from the customer(s) under a subscription and/or fee agreement; receive payment from the sale of advertising to one or more third parties, and/or the like.

The foregoing description of various aspects of the invention has been presented for purposes of illustration and description. It is not intended to be exhaustive or to limit the invention to the precise form disclosed, and obviously, many modifications and variations are possible. Such modifications and variations that may be apparent to an individual in the art are included within the scope of the invention as defined by the accompanying claims.

What is claimed is:

1. A computer-implemented system for automatically detecting fraudulent ticket redemptions, the system comprising:

an electronic data processing system operated by a loyalty program operator, the electronic data processing system being independent of a data processing systems operated by a state lottery and a lottery retailer; and a user account associated with a consumer and defined within the electronic data processing system, the user account configured to store a lottery transaction history provided by at least one of the consumer, the state lottery, the lottery retailer, and the loyalty program operator;

an electronic scanning device for optically scanning at least one gaming ticket;

a ticket image database operated by the loyalty program operator, wherein the ticket image database stores the at least one gaming ticket scanned with the electronic scanning device; and wherein the electronic data processing system is configured to provide least one contest to the consumer through the user account, and the contest is provided by the loyalty program operator independently of the state lottery and a lottery retailer contest; wherein the electronic data processing system further performs actions including:

transmitting the at least one gaming ticket to the ticket image database for storage as a ticket image, automatically extracting identifying information from the ticket image, determining whether the extracted identifying information matches a previously redeemed ticket, in response to the extracted identifying information not matching the previously redeemed ticket, entering the consumer into a lottery independent of the lottery retailer contest and the state lottery, and in response to the extracted identifying information matching the previously redeemed ticket, preventing re-use of the at least one gaming ticket.

2. The consumer gaming loyalty system of claim 1, wherein the lottery transaction history is stored in a financial records module of the user account, the financial records module including a spending history of the consumer.

3. The consumer gaming loyalty system of claim 1, further comprising a retailer account accessible to the retailer, the retailer account including a retailer-driven promotion.

4. The consumer gaming loyalty system of claim 1, further comprising a remotely-activated registration card for creating the user account.

5. The consumer gaming loyalty system of claim 4, wherein the remotely-activated registration card is one of a lottery ticket, a game ticket, and a receipt.

6. The consumer gaming loyalty system of claim 1, further comprising a consumer point balance stored in the user account, wherein the consumer point balance is exchangeable for entry in the at least one contest.

7. The consumer gaming loyalty system of claim 1, wherein the user account stores gaming transaction information pertaining to at least two state lotteries.

8. The consumer gaming loyalty system of claim 1, wherein the user account stores gaming transaction information pertaining to at least two retailers.

9. The consumer gaming loyalty system of claim 1, wherein the user account is accessible to the loyalty program operator on behalf of one of the retailer and the state lottery.

10. A computer-implemented method for automatically detecting fraudulent ticket redemptions, the method comprising:

verifying a lottery ticket submitted from a consumer to an electronic data processing system, the electronic data processing system being independent of data processing systems operated by a retailer-specific lottery and a state-specific lottery, wherein the lottery ticket corresponds to one of the state-specific lottery, the retailer-specific lottery, and an independent lottery, wherein the verifying includes:

scanning a ticket with an electronic scanning device, generating a ticket image from the scanned ticket, storing the ticket image in a ticket image database, automatically extracting identifying information from the ticket image, and determining whether the extracted identifying information matches a previously redeemed ticket;

associating the lottery ticket with a user account stored in the electronic data processing system, wherein the user account is independent of the retailer-specific lottery and the state-specific lottery;

in response to the extracted identifying information not matching the previously redeemed ticket, entering the consumer into a lottery independent of the retailer-specific lottery and the state-specific lottery; and in response to the extracted identifying information matching the previously redeemed ticket, preventing re-use of the ticket.

11. The method of claim 10, further comprising generating a transaction history for the consumer, the transaction history including one of a past state lottery entry, a past retailer lottery entry, and a past independent lottery entry.

12. The method of claim 10, further comprising generating a graphical success display for the consumer, wherein the graphical success display indicates one of a percent chance of success, a current winner name, and a drawing date for one of the state-specific lottery, the retailer-specific lottery, and an independent lottery.

13. The method of claim 12, wherein the state-specific lottery comprises two state-specific lotteries.

14. The method of claim 12, wherein the retailer-specific lottery comprises two retailer specific lotteries.

15. The method of claim 10, wherein the user account is accessible to at least one of a state-specific lottery operator, a retailer-specific lottery operator, and an independent lottery rewards operator.

16. The method of claim 10, wherein the lottery ticket comprises one of a physical ticket, a receipt, and a ticket serial number.

17. The method of claim 10, further comprising generating an transaction history for the user account, the entry history including lottery tickets for each of the state-specific lottery, the retailer-specific lottery, and the independent lottery.

18. The method of claim 10, further comprising increasing a point value for the user account in response to the verifying of the lottery ticket.

* * * * *